US005441419A

United States Patent [19]

Takazawa et al.

[11] Patent Number: 5,441,419

[45] Date of Patent: Aug. 15, 1995

[54] CONNECTOR FOR A FLEXIBLE CABLE

[75] Inventors: Tomoo Takazawa; Toshio Hori; Iwao Fukutani, all of Nagaokakyo, Japan

[73] Assignee: Murata Manufacturing Co., Ltd., Nagaokakyo, Japan

[21] Appl. No.: 191,169

[22] Filed: Feb. 3, 1994

[30] Foreign Application Priority Data

Feb. 4, 1993 [JP] Japan ..... 5-017139

[51] Int. Cl.[6] ..... H01R 9/09

[52] U.S. Cl. ..... 439/86; 439/67

[58] Field of Search ..... 439/714, 67, 492, 495, 439/607, 86

[56] References Cited

U.S. PATENT DOCUMENTS 4,639,062 1/1987 Taniguchi et al. ..... 439/86 X
4,754,546 7/1988 Lee et al. ..... 439/86 X
5,186,632 2/1993 Horton et al. ..... 439/67 OR
5,240,420 8/1993 Roberts ..... 439/67 X
5,276,817 1/1994 Matschke et al. ..... 439/67 X

*Primary Examiner*—Larry I. Schwartz
*Assistant Examiner*—Daniel Wittels
*Attorney, Agent, or Firm*—Burns, Doane, Swecker & Mathis

[57] ABSTRACT

A connector having a housing with a cavity, a terminal fixed in the housing and a resistance board. The resistance board has an elastic insulating board and a number of conductors which are provided in the insulating board such that each conductor shows on an upper surface and a lower surface of the insulating board. The resistance board is inserted in the cavity of the housing so as to lie on an end portion of a flexible cable. A signal-transmitting conductor of the flexible cable is electrically connected with the terminal via the conductors of the resistance board.

10 Claims, 2 Drawing Sheets

CONNECTOR FOR A FLEXIBLE CABLE

BACKGROUND OF THE INVENTION

1. Field of the Invention

The present invention relates to a connector, and more particularly to a connector for connecting electronic appliances to each other via a flexible cable or for connecting circuit boards to each other inside an appliance via a flexible cable.

2. Description of Related Art

Generally, a flexible cable which has signal-transmitting conductors on a flexible base is used for a connection between electronic appliances or for a connection between circuit boards inside all appliance. An end of the flexible cable is connected to a circuit board via a connector, and in order to prevent noise radiation, a noise suppressor is fitted, for example, in the following manners: (1) a noise suppressor is mounted around the connector on the circuit board; and (2) a noise suppressor such as a ring core is fitted to the flexible cable.

However, the above noise suppressing manners have the following disadvantages. In a case of (1), an exclusive space for the noise suppressor is required on the circuit board. In a case of (2), the ring core is expensive, and the fitting of the ring core to the flexible cable is complex work, which raise cost.

SUMMARY OF THE INVENTION

An object of the present invention is to provide a connector which also functions as a noise suppressor so as not to require a separate noise suppressor such as a ring core.

In order to attain the object, a connector according to the present invention comprises a housing, a terminal and a resistance board. The housing has a cavity in which an end portion of a flexible cable is to be inserted. The terminal is fixed in the housing such that one end of the terminal protrudes from the housing and that the other end faces the cavity. The resistance board has a number of conductors which are provided in an insulating board such that each conductor shows on an upper surface and a lower surface of the insulating board. The resistance board is inserted in the cavity to lie on the end portion of the flexible cable.

When the resistance board is inserted in the cavity on the end portion of the flexible cable, a conductor of the flexible cable is electrically connected with the terminal via the conductors of the resistance board. The terminal is connected with a specified electrode on a printed circuit board in an electronic appliance. In the structure, the resistance board transmits the signal between the conductor of the flexible cable and the terminal, and at the same time, prevents noise radiation. Thus, it is no more necessary to provide a separate noise suppressor on the circuit board and to provide an expensive ring core on the flexible cable.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

Exemplary connectors according to the present invention are described with reference to the accompanying drawings.

Figure 1:
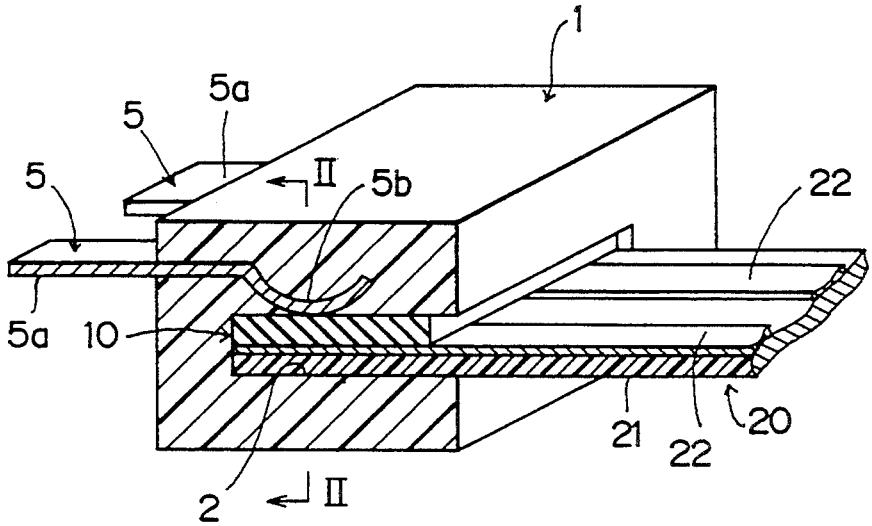
FIG. 1 is a perspective view of a connector which is a first embodiment of the present invention, the view being sectional taken substantially in the center.
Figure 2:
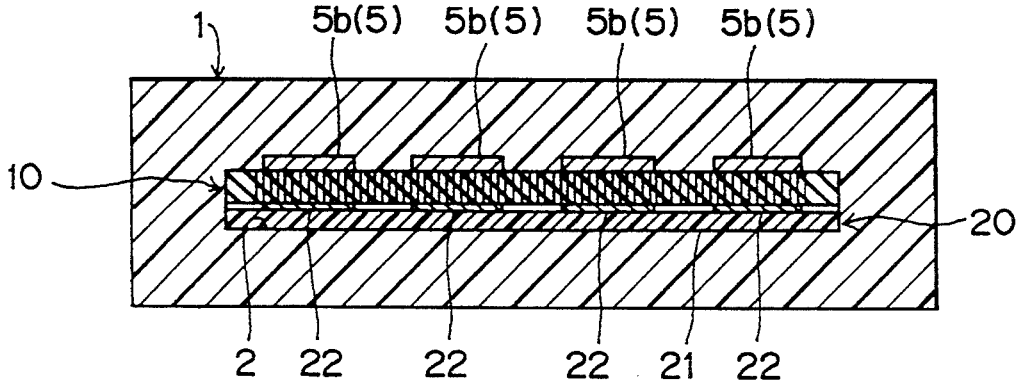
FIG. 2 is an elevational view of the connector, taken along a line II—II of FIG. 1.
Figure 3:
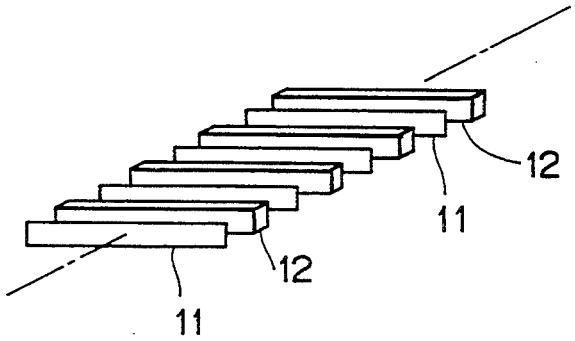
FIG. 3 is an exploded perspective view of a resistance board shown in FIGS. 1 and 2.

First Embodiment: FIGS. 1 through 3

FIGS. 1 and 2 show a connector which is a first embodiment of the present invention. The connector comprises a housing 1, terminals 5 and a resistance board 10. The connector is used to connect a flexible cable 20 to a printed circuit board (not shown). The flexible cable 20 has signal-transmitting conductors 22 (in the first embodiment, four conductors) on one side of an insulating flexible base 21.

The housing 1 is molded out of an insulating material (resin) and has a cavity 2 whose section is rectangular. The number of the terminals 5 is equal to that of the conductors 22 (four), and the terminals 5 arc fixed in the housing 1 by insert-molding at the same pitch as that of the conductors 22. The terminals 5 each have a protruding end 5*a* which protrudes from the housing 1 and an embedded end 5*b* which is embedded in the housing 1 at a place to face the cavity 2.

The resistance board 10, as shown in FIG. 3, is composed of conductive thin plates 11 made of metal and elastic insulating plates 12 made of elastomer. The conductive thin plates 11 and the insulating plates 12 are alternately stuck together such that each conductive thin plate 11 will surely show on both the upper surface and the lower surface of the finished resistance board 10. The resistance board 10 is pressed into the cavity 2 of the housing 1 together with the flexible cable 20. At that time, the resistance board 10 is positioned such that the conductive thin plates 11 are in parallel with the signal-transmitting conductors 22 of the cable 20. Thereby, the signal-transmitting conductors 22 are electrically connected with the respective terminals 5 via the conductive thin plates 11.

The protruding ends 5*a* of the terminals 5 are inserted and fixed in holes of a printed circuit board (not shown), and thus, the terminals 5 are electrically connected with circuits on the printed circuit board.

In the structure above, the resistance board 10 electrically connects the signal-transmitting conductors 22 with the terminals 5 and transmits the signals without distorting the waveform of the signals by its resistance. Additionally, the resistance board 10 eliminates noise. Hence, the connector does not require any noise suppressors. Since the main material of the resistance board 10 is elastomer, even if any mechanical force is applied to the resistance board 10, the electrical connections among the printed circuit board, the flexible cable 20 and the terminals 5 can be maintained. With the press-insertion of the resistance board 10, it is unlikely that the resistance board 10 will come out of the cavity 2. However, if the cavity 2 is coated with an adhesive resin, the fixation of the resistance board 10 will be more secure.

Figure 4:
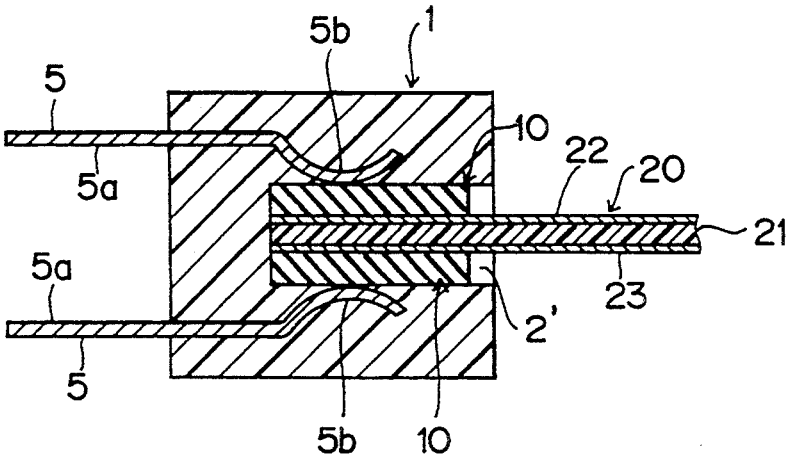
FIG. 4 is an elevational view of a connector which is a second embodiment of the present invention.

Second Embodiment; FIG. 4

FIG. 4 shows a connector which is a second embodiment of the present invention. This connector is for a flexible cable 20 which has signal-transmitting conductors 22 and 23 respectively on the upper side and the lower side of the base 21. The terminals 5 are positioned in two stories, and the embedded ends 5*b* of the terminals 5 face the upper side and the lower side of a cavity 2' of the housing 1.

In the connector, two resistance boards 10 are used. The resistance boards 10 are pressed into the cavity 2' so as to be positioned respectively along the upper side and the lower side of the flexible cable 20. The resistance boards 10 electrically connect the signal-transmitting conductors 22 and 23 with the respective terminals 5 by their resistance. The effect of the second embodiment is the same as that of the first embodiment.

Other Embodiments

Figure 5:
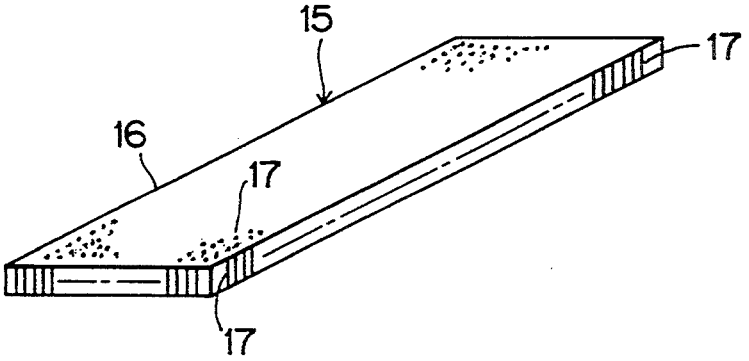
FIG. 5 is a perspective view of a modified resistance board.

The resistance board 10 may be replaced by another type of resistance board 15 shown in FIG. 5. The resistance board 15 has an elastic insulating board 16 made of elastomer and a large number of conductive needles 17 made of metal. The conductive needles 17 are embedded in the insulating board 16 such that each needle 17 shows both on the upper surface and the lower surface of the board 16. The resistance board 15 is inserted between the flexible cable 20 and the embedded ends 5*b* of the terminals 5. The resistance board 15 electrically connects the signal-transmitting conductors 22 and 23 with the respective terminals 5 without distorting the waveform of the signals by its resistance, and at the same time, eliminates noise.

The housing 1 and the terminals 5 may have any structure and configuration.

Although the present invention has been described in connection with the preferred embodiments above, it is to be noted that various changes and modifications are possible to those who are skilled in the art. Such changes and modifications are to be understood as being within the scope of the invention.

What is claimed is:

1. A connector comprising:

an insulating housing which has a cavity in which an end portion of a flexible cable having a signal-transmitting conductor on a flexible insulating base is to be inserted:

a terminal fixed in the housing such that one end of the terminal protrudes from the housing and that another end faces the cavity; and an elastic resistance board, which is inserted in the cavity of the housing so as to lie on the end portion of the flexible cable, electrically connecting the signal-transmitting conductor of the flexible cable with the terminal to reduce noise in signals transmitted between the signal-transmitting conductor and the terminal, the resistance board having an insulating board and a number of conductors which are provided in the insulating board such that each of the conductors is exposed on an upper surface and a lower surface of the insulating board.

2. A connector as claimed in claim 1, wherein the resistance board comprises:

a number of conductive plates and a number of elastic insulating plates which are alternately stuck together.

3. A connector as claimed in claim 1, wherein the resistance board comprises:

an elastic insulating board and a number of conductive needles embedded in the elastic insulating board.

4. A connector as recited in claim 1, wherein said elastic resistance board is removably inserted in said cavity of said housing, with said resistance board being press-fit into said housing with said flexible cable, such that a conductor of said resistance board is parallel with a conductor of said flexible cable and with said terminal.

5. A connector as recited in claim 1, wherein said elastic resistance board further includes:

an elastic insulating board and a number of conductors, said conductors being exposed on a first side of said resistance board and on a second side of said resistance board, said second side being opposite said first side.

6. A connector as recited in claim 5, wherein said number of conductors of said elastic resistance board are in electrical contact with plural signal-transmitting conductors of said flexible cable and with plural terminals fixed in said housing to reduce noise in signals transmitted between said number of conductors and said plural terminals.

7. A connector as recited in claim 1, wherein said terminal is insert-molded into said housing with a pitch equal to that of said signal-transmitting conductor when said flexible cable is inserted in said insulating housing.

8. A connector as recited in claim 1, further including:

a plurality of terminals fixed in said housing, a number of said plurality of terminals corresponding to a number of signal-transmitting conductors on said flexible insulating base of said flexible cable, each of said plurality of terminals having a first end which protrudes from said housing and a second end which is embedded in said housing, each of said embedded ends being exposed within said cavity.

9. A connector as recited in claim 1, further including:

at least one additional resistance board press-fit into said cavity.

10. A connector as recited in claim 3, wherein said conductive needles electrically connect a plurality of terminals insert-molded in said housing with a plurality of signal-transmitting conductors on said flexible insulating base of said flexible cable.

* * * * *